US010905187B1

(12) United States Patent
Bochner et al.

(10) Patent No.: US 10,905,187 B1
(45) Date of Patent: Feb. 2, 2021

(54) COLLAPSIBLE HELMET

(71) Applicant: GWENVENTIONS, LLC, New York, NY (US)

(72) Inventors: Ronnie Z. Bochner, New York, NY (US); Mario A. Turchi, Tenafly, NJ (US); Steven Madsen, New York, NY (US)

(73) Assignee: GWENVENTIONS, LLC, New York, NY (US)

( * ) Notice: Subject to any disclaimer, the term of this patent is extended or adjusted under 35 U.S.C. 154(b) by 0 days.

(21) Appl. No.: 16/834,991

(22) Filed: Mar. 30, 2020

(51) Int. Cl.
*A42B 3/32* (2006.01)
*A42B 3/12* (2006.01)
*A42B 3/06* (2006.01)

(52) U.S. Cl.
CPC ..... *A42B 3/322* (2013.01); *A42B 3/06* (2013.01); *A42B 3/127* (2013.01)

(58) Field of Classification Search
CPC ..... A42B 3/32; A42B 3/322; A42B 3/069; A42B 3/125; A42B 3/127; A42B 3/06; A42B 3/12; A42B 3/066; A42B 1/20; A42B 1/201; A42B 1/069; A42B 1/205; A63B 71/10
See application file for complete search history.

(56) References Cited

U.S. PATENT DOCUMENTS

| | | | |
|---|---|---|---|
| 1,364,662 | A | 1/1921 | Wagner |
| 3,023,134 | A | 2/1962 | Cresswell |
| 3,197,784 | A | 8/1965 | Carlisle |
| 3,353,188 | A | 11/1967 | Crincic |
| 3,440,660 | A | 4/1969 | Krinke |
| 3,495,272 | A | 2/1970 | Tempelhof |
| 3,514,787 | A | 6/1970 | Kennedy, Jr. |
| 3,991,422 | A | 11/1976 | Saotome |
| 4,443,891 | A | 4/1984 | Blomgren |
| 4,607,397 | A | 8/1986 | Laxo |
| 4,827,537 | A | 5/1989 | Villa |
| 4,856,119 | A | 8/1989 | Haberle |
| 5,012,533 | A | 5/1991 | Raffler |
| 5,173,970 | A | 12/1992 | Shifrin |

(Continued)

FOREIGN PATENT DOCUMENTS

| | | | |
|---|---|---|---|
| CN | 203378603 | U | 1/2014 |
| CN | 205143616 | U | 4/2016 |

(Continued)

OTHER PUBLICATIONS

Indiegogo, "Park & Diamond: Foldable Bike Helmet" (last visited Sep. 8, 2020) https://www.indiegogo.com/projects/park-diamond-foldable-bike-helmet#/.

*Primary Examiner* — Amy Vanatta
(74) *Attorney, Agent, or Firm* — Lewis Roca Rothgerber Christie LLP

(57) ABSTRACT

A collapsible helmet for use in various athletic activities, and which includes a structure that facilitates collapsing the helmet into a compact position for storage and/or transport of same. The helmet includes an outer shell having an inner cavity, and one or more flexible sheets, each of which includes a center portion and a plurality of segments. The sheets are positioned in the inner cavity such that they are movable and slideable relative to the outer shell and each other so as to allow the helmet to be collapsed from an open position to a collapsed position.

13 Claims, 10 Drawing Sheets

(56) References Cited

U.S. PATENT DOCUMENTS 5,272,773 A 12/1993 Kamata
5,365,607 A 11/1994 Benevento, Jr.
RE35,195 E 4/1996 Shifrin
5,515,546 A 5/1996 Shifrin
5,544,367 A 8/1996 March, II
5,628,071 A 5/1997 Nezer
5,661,854 A * 9/1997 March, II ..... A42B 3/00 2/410
5,729,830 A 3/1998 Luhtala
5,745,923 A 5/1998 Katz
5,887,289 A 3/1999 Theoret
5,896,587 A 4/1999 Gentry
5,896,590 A 4/1999 Fleisch
6,154,889 A * 12/2000 Moore, III ..... A42B 3/06 2/411
6,397,399 B1 6/2002 Lampe
6,442,765 B1 * 9/2002 Fallon ..... A42B 3/066 2/410
6,904,617 B2 6/2005 Tsai
7,010,814 B2 3/2006 Benziger
7,043,761 B2 5/2006 Epling
7,937,778 B1 5/2011 Norton
7,958,572 B2 6/2011 Loury et al.
8,262,601 B2 9/2012 Cumming
8,613,114 B1 12/2013 Olivares
8,713,717 B2 5/2014 Cleva
8,739,316 B1 6/2014 Norton
8,789,212 B2 7/2014 Cleva
8,850,622 B2 10/2014 Finiel
8,978,167 B2 3/2015 Blair
9,554,611 B2 1/2017 Arrouart
9,693,594 B1 7/2017 Castro et al.
10,201,208 B1 2/2019 Bochner
2002/0023291 A1 2/2002 Mendoza
2004/0163162 A1 8/2004 Benziger
2004/0250340 A1 12/2004 Piper
2004/0255369 A1 12/2004 Puchalski
2005/0028253 A1 2/2005 Fowler
2005/0246824 A1 11/2005 Berger
2005/0257312 A1 11/2005 Puchalski
2006/0059606 A1 3/2006 Ferrara
2006/0085881 A1 4/2006 Gellis
2007/0157370 A1 * 7/2007 Joubert Des Ouches ..... A42B 3/064 2/410
2008/0172779 A1 7/2008 Ferguson
2009/0222975 A1 9/2009 Green
2010/0031426 A1 2/2010 Lapham
2011/0307997 A1 * 12/2011 Blair ..... A42B 3/125 2/414
2012/0066820 A1 3/2012 Fresco
2013/0061373 A1 3/2013 Cleva
2013/0097767 A1 4/2013 Cleva
2013/0152274 A1 6/2013 Welch
2013/0191972 A1 8/2013 Woolf
2013/0289459 A1 10/2013 Bernardoni
2013/0305435 A1 11/2013 Surabhi
2013/0318690 A1 12/2013 Cleva
2014/0020158 A1 * 1/2014 Parsons ..... A42B 3/121 2/413
2014/0207657 A1 7/2014 Gacs
2014/0223641 A1 8/2014 Henderson
2014/0237706 A1 8/2014 O'Conner
2015/0047109 A1 2/2015 Grant et al.
2015/0089725 A1 4/2015 Lowe et al.
2015/0305423 A1 * 10/2015 Pusateri ..... A42B 1/08 2/2.5
2016/0000168 A1 * 1/2016 Allen ..... A42B 3/08 2/414
2016/0157548 A1 6/2016 Copeland
2016/0324247 A1 * 11/2016 Warmouth ..... A42B 3/283
2017/0251747 A1 9/2017 Pippin
2018/0049508 A1 2/2018 Terry
2018/0153244 A1 * 6/2018 Kirshon ..... A42C 2/00
2019/0029357 A1 * 1/2019 Bochner ..... A42B 3/006
2019/0166946 A1 * 6/2019 Vito ..... A42B 1/08
2019/0307199 A1 10/2019 Hall et al.

FOREIGN PATENT DOCUMENTS

GB 2527173 A 12/2015
JP 2005232663 A 9/2005
JP 2010185147 A 8/2010

* cited by examiner

COLLAPSIBLE HELMET

FIELD OF THE INVENTION

The present invention relates to protective headwear and, more particularly, to a helmet that is collapsible and a method relating thereto.

BACKGROUND OF THE INVENTION

Helmets are used to protect against head trauma and injuries in many athletic activities. At least some of the people who engage in such activities seek such protection, but also prefer that the helmet is compact and easy to store and carry. As such, a collapsible helmet is desirable.

SUMMARY OF THE INVENTION

The present invention provides a new and improved collapsible helmet for use in various athletic activities, and which includes a structure that facilitates collapsing the helmet into a compact position for storage and/or transport of same. More particularly, the collapsible helmet is manually collapsible between an open position, in which the helmet can be fitted to a user's head, and a collapsed position, in which opposing sides of the helmet can be compressed towards each other so as to form the helmet into an elongated shape.

In one embodiment, the collapsible helmet includes an outer shell made from a flexible material and configured to form a protective, hemispherical outer layer. The collapsible helmet also includes a first sheet made from a flexible, shock-absorbing material and adapted to be nested in the outer shell. The first sheet has a first center portion and a plurality of first segments, each of which extends outwardly from the first center portion. The first center portion and the first segments are shaped into a substantially hemispheric shape so as to form a first inner hemispheric layer. The first sheet is movably and slideably retained in the outer shell.

In one embodiment, the helmet also includes and a second sheet made from a flexible, shock-absorbing material and adapted to be nested in the first sheet. The second sheet has a second center portion and a plurality of second segments, each of which extends outwardly from the second center portion. The second center portion and the second segments are formed into a substantially hemispherical shape so as to form a second hemispherical inner layer. The second sheet is movably and slideably retained in the first sheet.

BRIEF DESCRIPTION OF THE DRAWINGS

In the drawing figures, which are not to scale, and where like reference numerals indicate like elements throughout the several views.

DETAILED DESCRIPTION OF EXEMPLARY EMBODIMENTS

Figure 1:
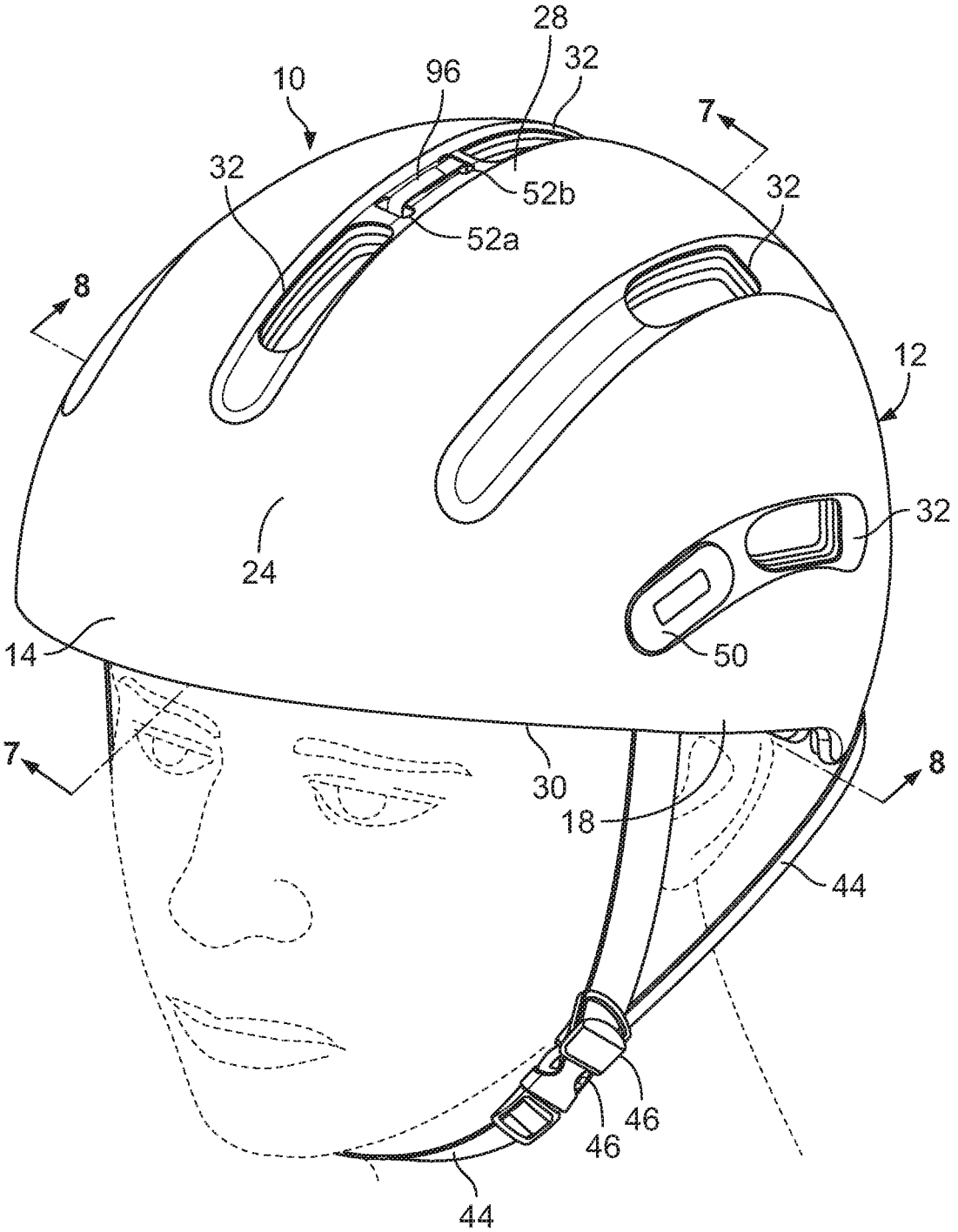
FIG. 1 is a front perspective view of a helmet constructed in accordance with an embodiment of the present invention.

Various embodiments are disclosed herein; however, it is to be understood that the disclosed embodiments are merely illustrative of the disclosure that can be embodied in various forms. In addition, each of the examples given in connection with the various embodiments is intended to be illustrative, and not restrictive. Further, the figures are not necessarily to scale, and some features may be exaggerated to show details of particular components (and any size, material and similar details shown in the figures are intended to be illustrative and not restrictive). Therefore, specific structural and functional details disclosed herein are not to be interpreted as limiting, but merely as a representative basis for teaching one skilled in the art to variously employ the disclosed embodiments.

Subject matter will now be described more fully hereinafter with reference to the accompanying drawings, which form a part hereof, and which show, by way of illustration, specific example embodiments. Subject matter may, however, be embodied in a variety of different forms and, therefore, covered or claimed subject matter is intended to be construed as not being limited to any example embodiments set forth herein; exemplary embodiments are provided merely to be illustrative. Among other things, for example, subject matter may be embodied as methods, devices, components, or systems. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms, such as "and", "or", or "and/or," as used herein may include a variety of meanings that may depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

Figure 2:
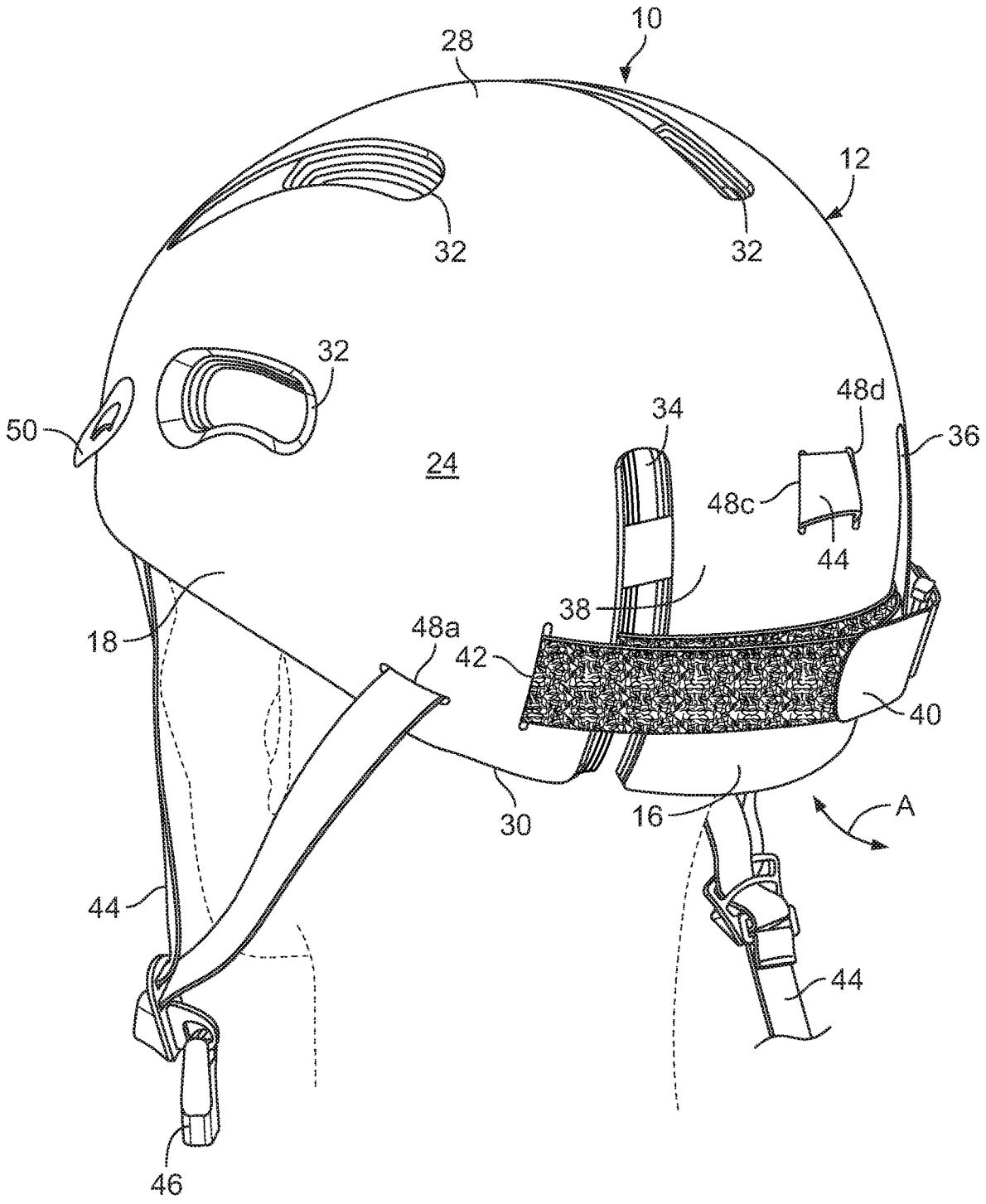
FIG. 2 is a rear perspective view of the helmet shown in FIG. 1.
Figure 10:
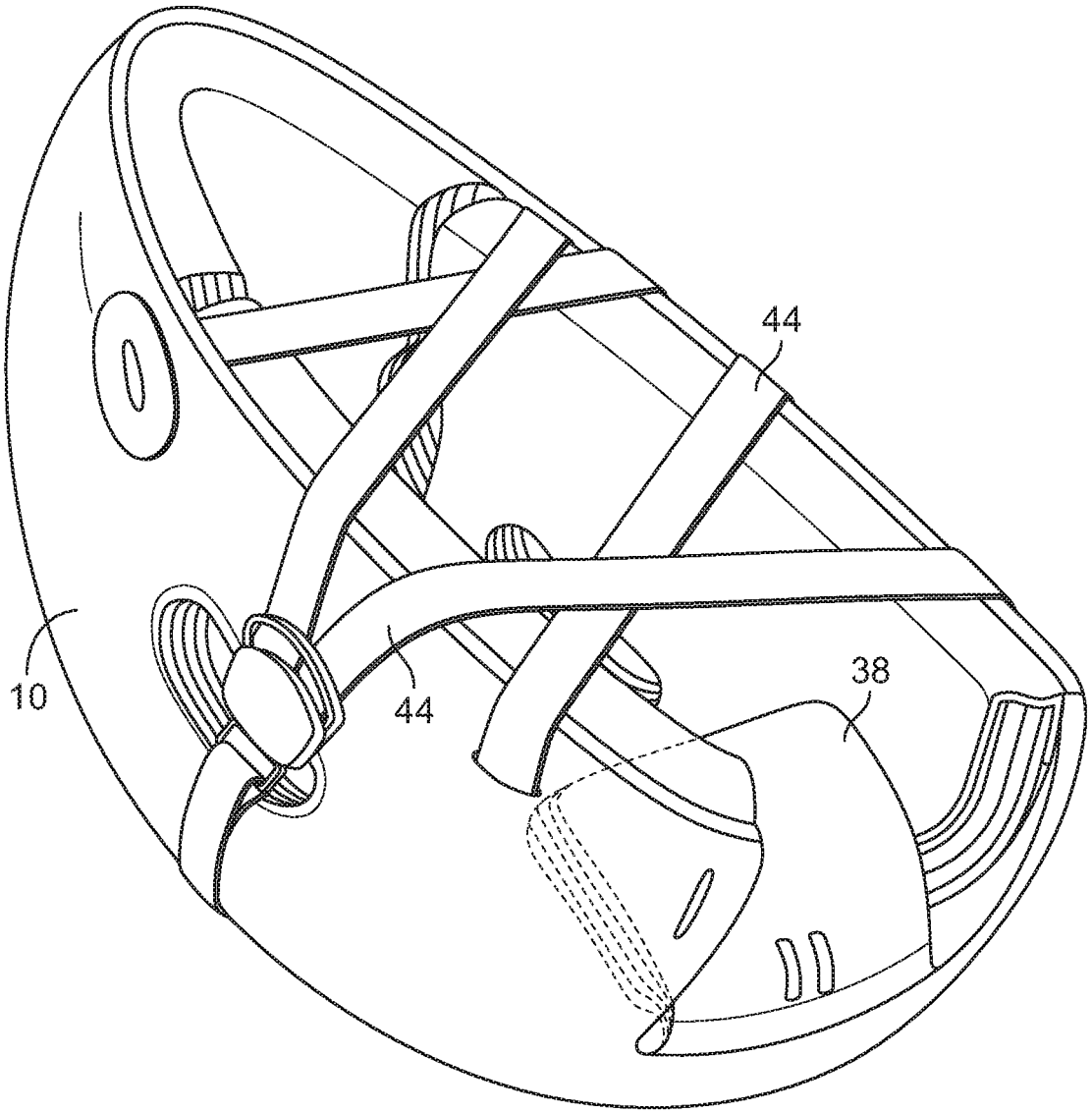
FIG. 10 is a view similar to FIG. 9, expect that the helmet is shown in its collapsed position and is maintain in that position by straps.
Figure 11:
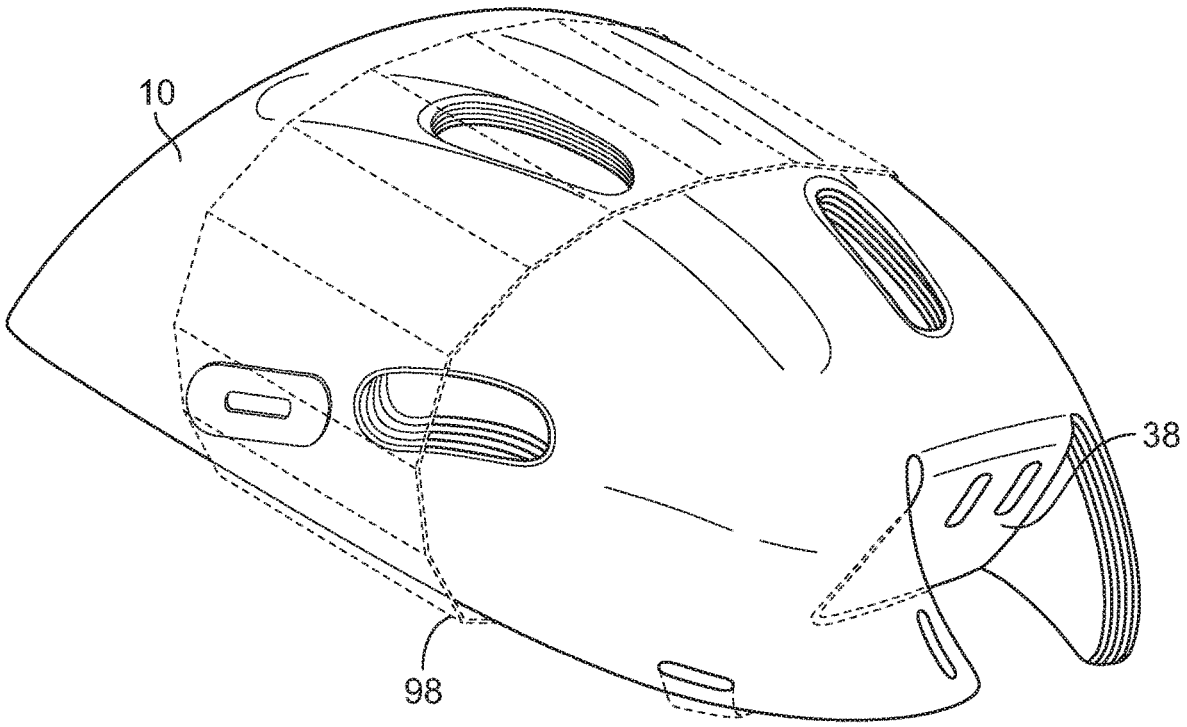
FIG. 11 is a top perspective view of the helmet shown in FIG. 10, the helmet being maintained in its collapsed position by a band.

The present disclosure relates to the helmet shown and described in U.S. Pat. No. 10,201,208 entitled "FOLDABLE HELMET", the entire disclosure of which is herein by reference. With reference to FIGS. 1 and 2, there is shown a helmet 10 constructed in accordance with an embodiment of the present invention. More particularly, the helmet 10 is provided with sufficient flexibility such that it is collapsible from its fully open, in-use position (as shown in FIGS. 1 and 2) to its collapsed position (as shown in FIGS. 10 and 11), as will be discussed in greater detail below. In one embodiment, the helmet 10 includes an outer shell 12 having front and rear portions 14, 16 and lateral side portions 18, 20 (see also FIG. 8), as well as an inner surface 22, an outer surface 24 and an inner cavity 26 (see FIGS. 7 and 8). The outer shell 12, which has a top 28 and a bottom 30, is fabricated from a material that is flexible but firm, so as to protect a user's head during an impact. Non-limiting examples of such materials include rubber, vinyl, flexible plastic and fiber mesh. In one embodiment, the outer shell 12 includes a plurality of vents 32 for allowing air ventilation from the helmet 10.

Figure 8:
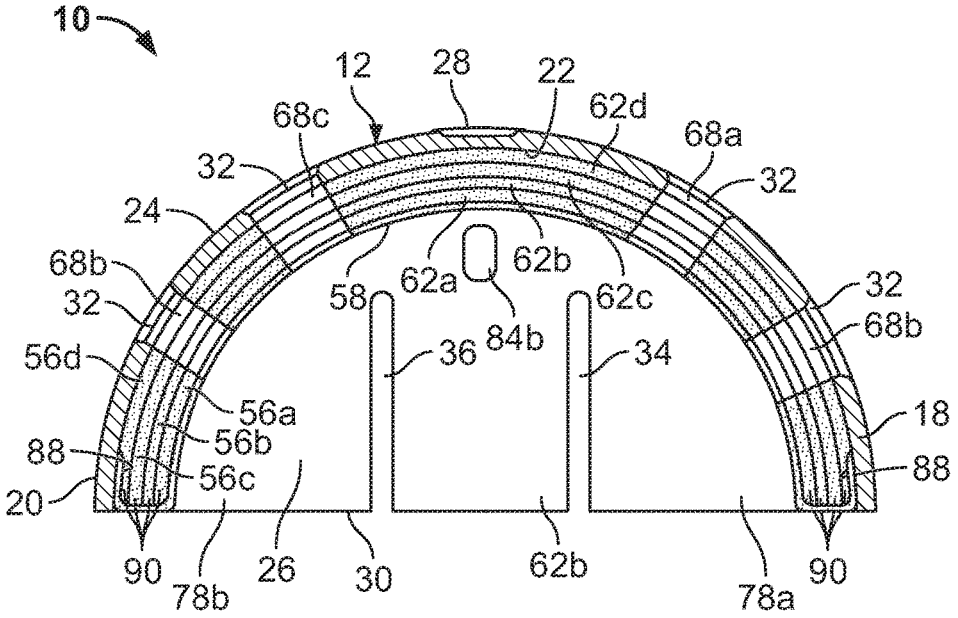
FIG. 8 is a cross-sectional view, taken along section line 8-8 and looking in the direction of the arrows, of the helmet show in FIG. 1.
Figure 9:
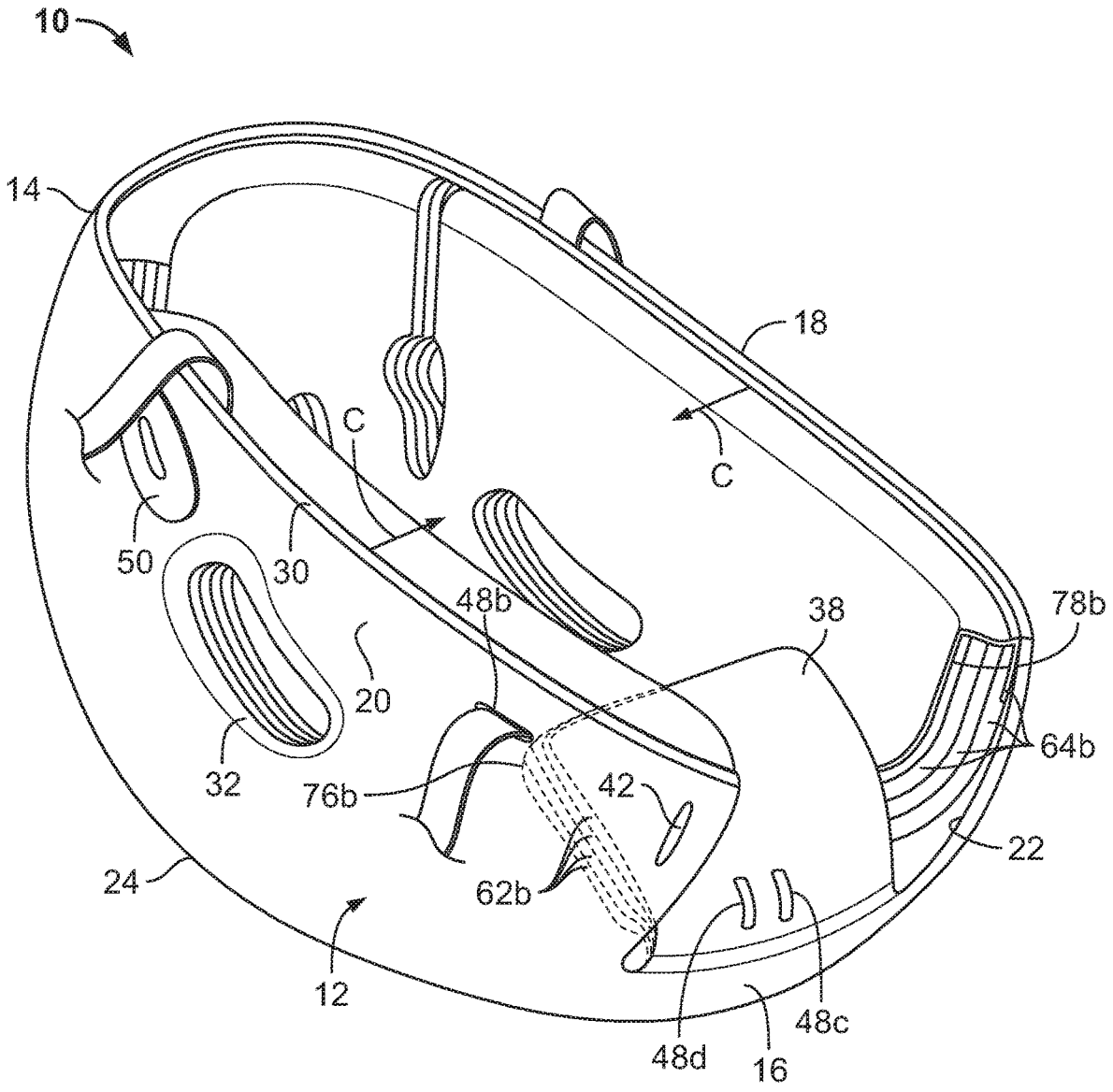
FIG. 9 is an upside-down, perspective view of the helmet shown in FIG. 1, the helmet having a flap which is shown in its folded or collapsed position.

In one embodiment, slits 34, 36 (see FIGS. 2 and 8) are formed in the rear portion 14 of the outer shell 12 to define a pivotable flap 38 (see also FIG. 9). More particularly, each of the slits 34, 36 projects upwardly from the bottom 30 of the outer shell 12 and terminates short of reaching the top 28. The flap 38 is pivotable inwardly and outwardly (as indicated by the arrows A in FIG. 2) so as to accommodate differently sized heads. In one embodiment, the helmet 10 is provided with an adjustable strap or straps 40 looped around the flap 38 through slots 42 (see FIGS. 2 and 9) formed in the outer shell 12 adjacent the rear portion 16 for adjusting and/or maintaining the position of the flap 38. By loosening or tightening the strap 40, the position of the flap 38 can be adjusted such that the helmet 10 can fit over differently sized heads. In one embodiment, the strap 40 is provided with hook and loop mechanisms (such as the hook and loop mechanism sold under the trademark VELCRO) for securing the length of the loop formed by the strap 40 once its length has been adjusted. In another embodiment, other suitable mechanisms may be used for adjusting and/or mainlining the length of the loop formed by the strap 40.

In one embodiment, the flap 38 is movable between its in-use, unfolded position, in which it is substantially in alignment with the side portions 18, 20 of the outer shell 12 (see FIG. 2), and its folded or collapsed position, in which it is pivoted into the inner cavity 26 of the outer shell 12 to accommodate collapsing of the side portions 16, 18 of the helmet 12 toward one another (see FIGS. 9-11). Placement of the flap 38 in its collapsed position allows the helmet 10 to be collapsed into a storage shape, as will be discussed in greater detail below.

With reference to FIGS. 1 and 2, the helmet 10 is provided with straps 44 and clasps 46 for securing the helmet 10 to a user's head. More particularly, the straps 44 are attached to the helmet 10, and in particular, the outer shell 12, by threading or passing same through various slots formed at desired locations on the outer shell 12. In one embodiment, the straps 44 pass through slots 48*a*, 48*b* formed adjacent the rear portion 16 of the outer shell 12, as well as slots 48*c*, 48*d* formed in the flap 38 (see FIGS. 2 and 9). In another embodiment, retaining tabs 50 (see FIGS. 1, 2 and 9) are attached to ends of the straps 46 so as to secure same to the outer shell 12.

In one embodiment, the outer shell 12 is also provided with slots 52*a*, 52*b* (see FIGS. 1, 3 and 7) adjacent the top portion 28. The functions of the slots 52*a*, 52*b* will be discussed below. In another embodiment, the slots 52*a*, 52*b* may be removed or replaced by other suitable mechanisms.

Figure 3:
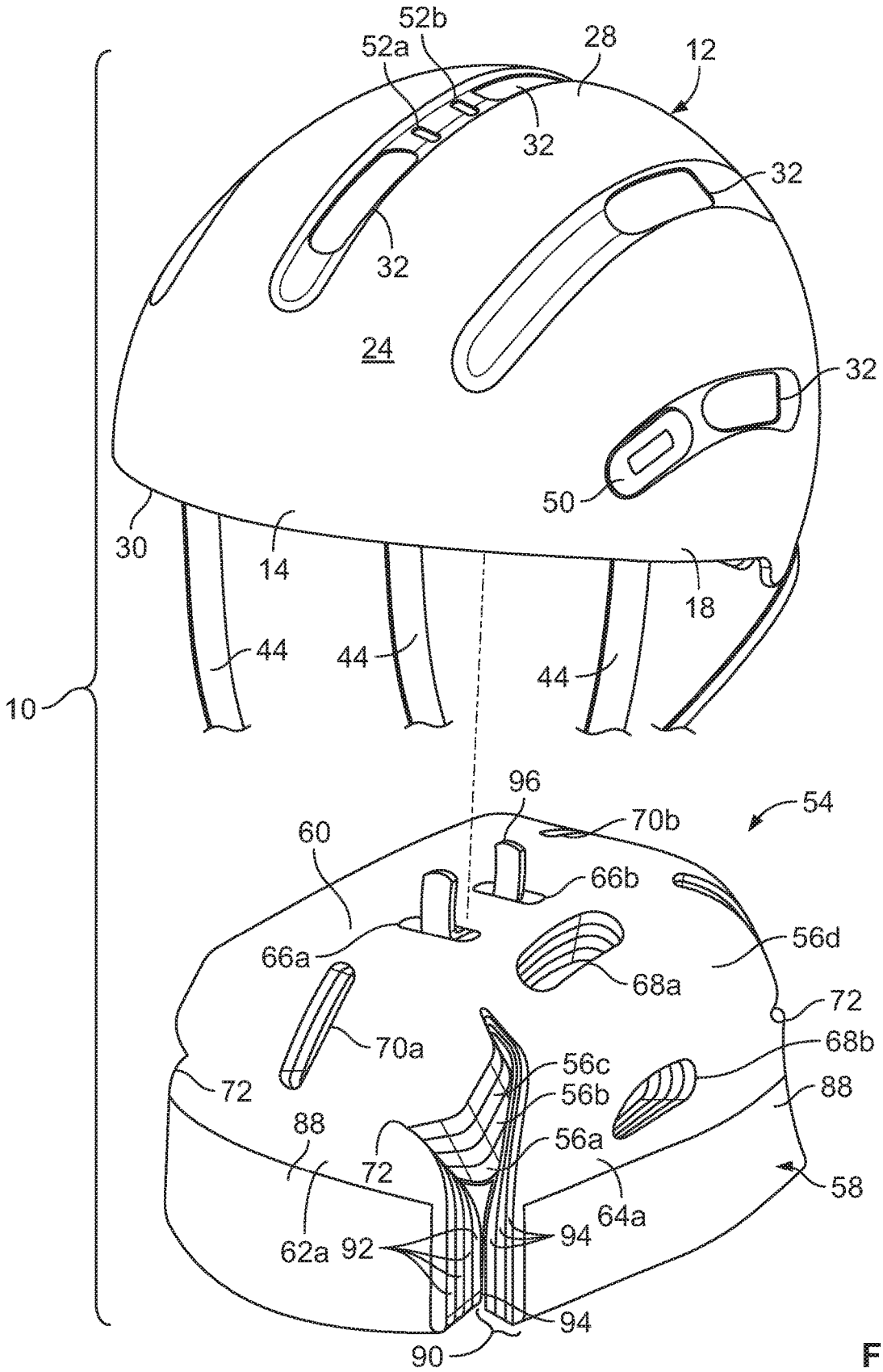
FIG. 3 is a partially exploded, perspective view of the helmet shown in FIG. 1, the helmet including a shock-absorbing unit which is shown in the figure after its removal from the helmet.

Now referring to FIG. 3, the helmet 10 includes a shock-absorbing unit or insert 54 removably or fixedly positioned in the inner cavity 26 of the outer shell 12 for absorbing and/or dissipating shock or energy during an impact and thereby protecting a user's head. More particularly, the shock-absorbing unit 54 includes a plurality of flexible sheets 56*a*, 56*b*, 56*c*, 56*d* (see FIG. 4). In one embodiment, each of the sheets 56*a*-56*d* is formed as a single, monolithic piece made from a shock-absorbing material, such as polystyrene foam (e.g., the foam material sold under the trademark "STYROFOAM"), sponge materials, polyethylene foam (e.g., the PE foam material sold under the name REFLECTIX CF70550), or any other suitable flexible material that absorbs shock. The sheets 56*a*-56*d* are placed one on top of another and arranged or shaped into a generally hemispherical shape (see FIG. 3) so as to define hemispheric layers. In one embodiment, the sheet 56*d*, which is the outer most layer of the shock-absorbing unit 54, is placed on, and is in contact with, the sheet 56*c*, which, in turn, is placed on, and is in contact with the sheet 56*b*. The sheet 56*b* is placed on, and is in contact with, the sheet 56*a*, which is the inner most layer of the shock-absorbing unit 54. In one embodiment, the shock-absorbing unit is equipped with an optional lining layer 58 lining the inside of the shock-absorbing unit 44 (i.e., the sheet 56*a*) so as to provide comfort to a user.

Figure 4:
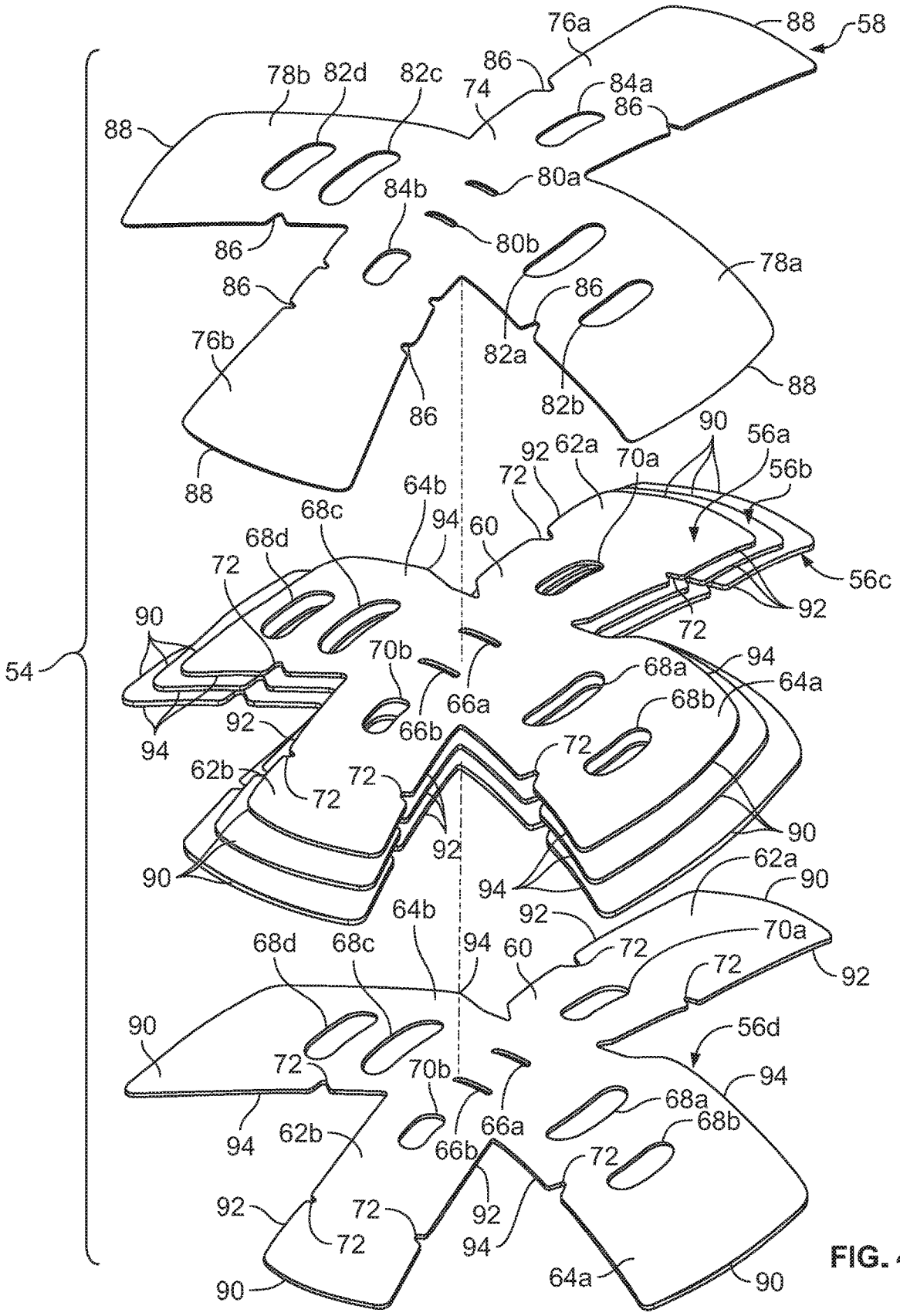
FIG. 4 is a partially exploded, perspective view of flexible sheets and a lining layer of the shock-absorbing unit shown in FIG. 3, the flexible sheets and the lining layer being shown in their generally planar configurations prior to formation of the shock-absorbing unit.
Figure 5:
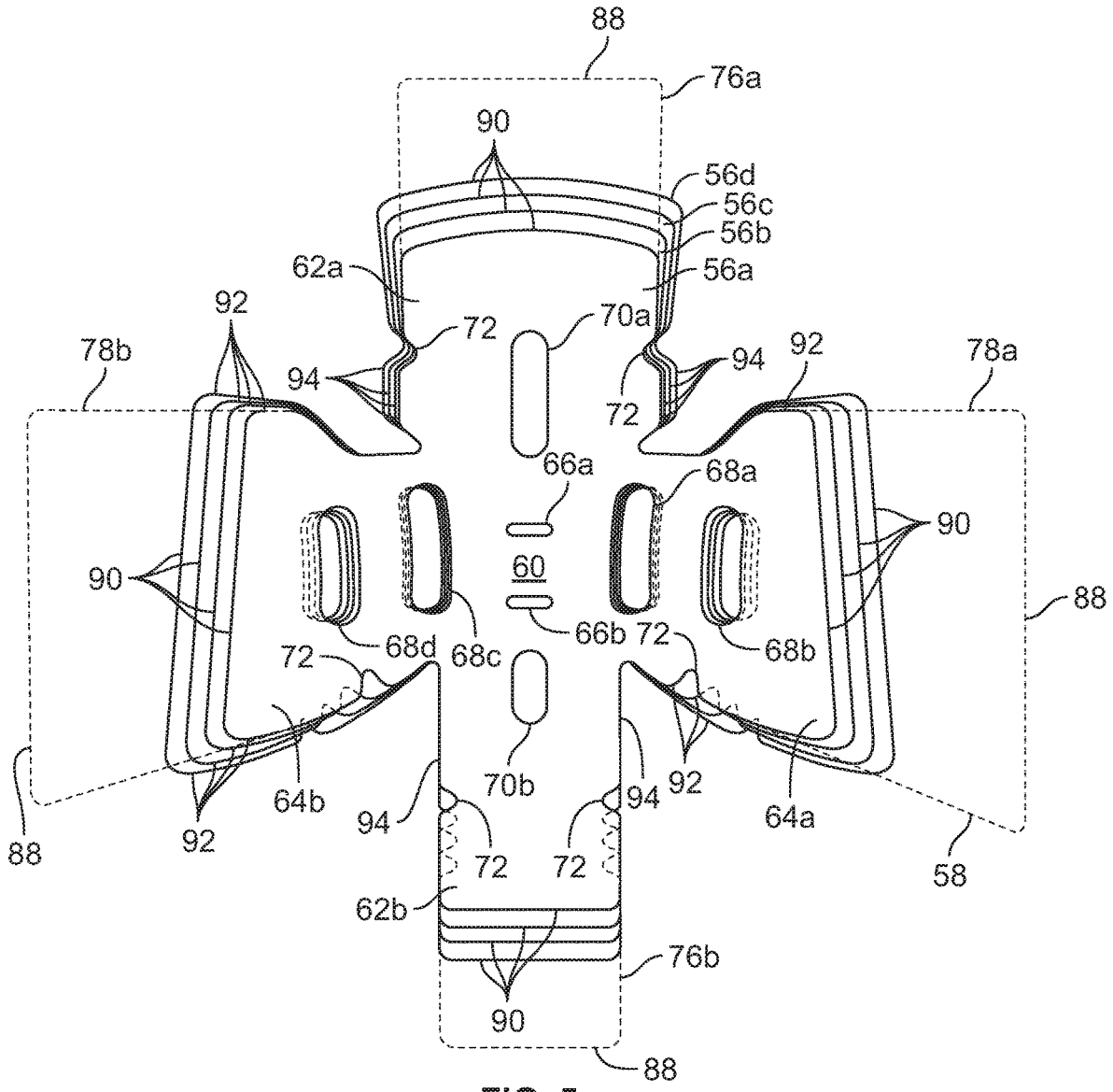
FIG. 5 is a plan view of the flexible sheets and the lining layer shown in FIG. 4, the flexible sheets and the lining layer being stacked together prior to formation of the shock-absorbing unit.
Figure 6:
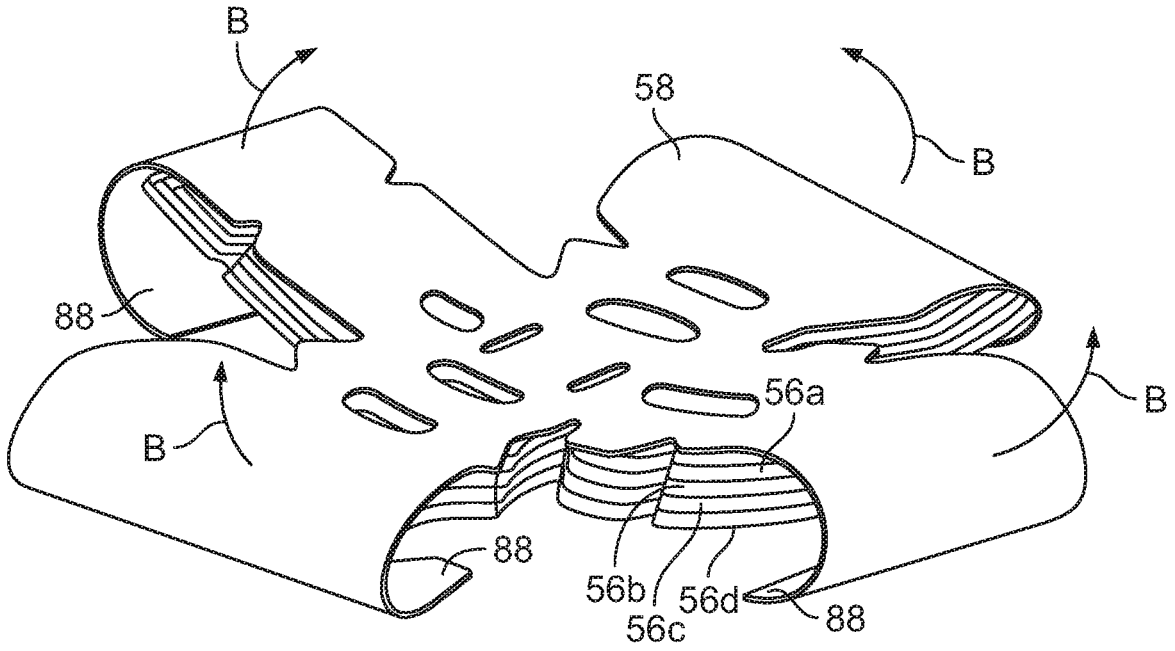
FIG. 6 is a perspective view of the flexible sheets and the lining layer shown in FIGS. 4 and 5 prior to formation of the shock-absorbing unit.

Now referring to FIGS. 4-6, the sheets 56*a*-56*d* have shapes that are similar to each other. In one embodiment, each of the sheets 56*a*-56*d* has a generally cross shape, including a center portion 60, axial segments 62*a*, 62*b*, which extend from the center portion 60 in a generally axial direction (i.e., in a direction along an axial axis extending from the front portion 14 to the rear portion 16), and lateral segments 64*a*, 64*b*, which extend from the center portion 60 in a lateral direction, which is generally perpendicular to the axial direction (i.e., in a direction along a lateral axis extending from the side portion 18 to the side portion 20). In one embodiment, the axial segment 62*a* and lateral segments 64*a*, 64*b* of each of the sheets 56*a*-56*d* has a flared shape as it extends outwardly from its respective center portion 60, while the axial segment 62*b* of each of the sheets 56*a*-56*d* has a substantially uniform width. In one embodiment, the axial and lateral segments 62*a*, 62*b*, 64*a*, 64*b* of each of the sheets 56*a*-56*d* are formed monolithically with their corresponding center portions 60. In another embodiment, the axial and lateral segments 62*a*, 62*b*, 64*a*, 64*b* and the center portion 60 can be formed from separate elements attached or fused to each other.

As illustrated in FIGS. 4 and 5, the axial and lateral segments 62*a*, 62*b*, 64*a*, 64*b* of the sheets 56*a*-56*d* have successively increasing sizes. More particularly, the widths of the lateral segments 64*a*, 64*b* of the sheet 56*d* are larger than those of the lateral segments 64*a*, 64*b*, respectively, of the sheet 56*c*. Similarly, the widths of the lateral segments 64*a*, 64*b* of the sheet 56*c* are larger than those of the lateral segments 64*a*, 64*b*, respectively, of the sheet 56*b*, while the widths of the lateral segments 64*a*, 64*b* of the sheet 56*b* are larger than those of the lateral segments 64*a*, 64*b*, respectively, of the sheet 56*a*. Likewise, the lengths of the axial segments 62*a*, 62*b* of the sheet 56*d* are larger than those of the axial segments 62*a*, 62*b*, respectively, of the sheet 56*c*; the lengths of the axial segments 62*a*, 62*b* of the sheet 56*c* are larger than those of the axial segments 62*a*, 62*b*, respectively, of the sheet 56*b*; and the lengths of the axial segments 62*a*, 62*b* of the sheet 56*b* are larger than those of the axial segments 62*a*, 62*b*, respectively, of the sheet 56*a*.

In one embodiment, each of the sheets 56*a*-56*d* has slots 66*a*, 66*b* positioned in the center portion 60 of a corresponding one of the sheets 56*a*-56*d* for purposes to be discussed below. In another embodiment, openings 68*a*, 68*b* and openings 68*c*, 68*d* are provided in the lateral segments 64*a*, 64*b*, respectively, of each of the sheets 56*a*-56*d*. In a further embodiment, openings 70*a*, 70*b* are provided in the axial segments 62*a*, 62*b*, respectively, of each of the sheets 56*a*-56*d*. The openings 68*a*-68*d*, 70*a*, 70*b* of the sheets 56*a*-56*d* are adapted to align with one another when the sheets 56*a*-56*d* are formed into the shock-absorbing unit 54 (and with the vents 32 of the outer shell 12 when the shock-absorbing unit 54 is inserted into the outer shell 12) so to provide air ventilation to the helmet 10. In other embodiments, each of the axial segments 62*a*, 62*b* and the lateral segments 64*a*, 64*b* of the sheets 56*a*-56*d* includes one or more notches 72 to facilitate bending of the axial segments 62*a*, 62*b* and the lateral segments 64*a*, 64*b* during the formation of the shock-absorbing unit 54 and allow axial segments 62*a*, 62*b* and the lateral segments 64*a*, 64*b* to conform to a wearer's head.

In one embodiment, each of the sheets 56*a*-56*d* has a thickness ranging from about ⅛ inches to 0.25 inches. Thus, in an embodiment of the helmet 10 having four (4) sheets 56*a*-56*d*, the aggregate thickness of the sheets 56*a*-56*d* will range from about 0.75 inches to about 1.0 inch. In other embodiments, each of the sheets 56*a*-56*d* has a different thickness. Non-limiting examples include about 0.1 inches, about 0.4 inches, about 0.5 inches and about 0.75 inches.

With reference to FIGS. 4-6, the lining layer 58 can be made from any synthetic or natural material suitable for functioning as a lining material, such as a synthetic or natural textile material, a synthetic or natural foam material, or a combination of same (e.g., a synthetic or natural foam laminated to a synthetic or natural textile material). The lining layer 58 has a generally cross shape and includes a center portion 74, axial segments 76*a*, 76*b* and lateral segments 78*a*, 78*b*. In one embodiment, the lining layer 58 has slots 80*a*, 80*b* located in the center portion 74 for purposes to be discussed below. In another embodiment, openings 82*a*, 82*b* and openings 82*c*, 82*d* are provided in the lateral segments 78*a*, 78*b*, respectively, while openings 84*a*, 84*b* are provided in the axial segments 76*a*, 76*b*, respectively. The openings 82*a*-82*d*, 84*a*, 84*b* of the lining layer 58 are adapted to align with the openings 68*a*-68*d*, 70*a*, 70*b*, respectively, of each of the sheets 56*a*-56*d* for ventilating air from the helmet 10. In other embodiments, each of the axial segments 76*a*, 76*b* and the lateral segments 78*a*, 78*b* of the lining layer 58 includes one or more notches 86 that conform to the notches 72 of the sheets 56*a*-56*d*.

Still referring to FIGS. 4-6, the sheets 56*a*-56*d* and the lining layer 58 are separate and discrete layers, which are assembled together to form the shock-absorbing unit 54. In one embodiment, each of the sheets 56*a*-56*d* and the lining layer 58, in its unassembled state, has a generally planar configuration, as illustrated in FIGS. FIGS. 4 and 5. To form the shock-absorbing unit 54, the sheets 56*a*-56*d* are placed sequentially one on top of another. More particularly, the sheet 56*c* is placed on the sheet 56*d*, the sheet 56*b* is placed on the sheet 56*c*, and the sheet 56*a* is placed on the sheet 56*b*. A top plan view of the sheets 56*a*-56*d* placed on top of each other as discussed above is shown in FIG. 5. The lining layer 58 is then placed on the sheets 56*a* (see the broken-line representation of the lining layer 58 in FIG. 5). As illustrated in FIG. 5, the lining layer 58 is sized such that an end 88 of each of the axial and lateral segments 76*a*, 76*b*, 78*a*, 78*b* extend beyond an end 90 of a corresponding one of the axial and lateral segments 62*a*, 62*b*, 64*a*, 64*b*, respectively, of the sheets 56*a*-56*d*. In one embodiment, the lining layer 58 may be eliminated or replaced with another mechanism.

Once the sheets 56*a*-56*d* and the lining layer 58 are assembled as illustrated in FIG. 5, the ends 88 of the axial and lateral segments 76*a*, 76*b*, 78*a*, 78*b* of the lining layer 58 are folded over the ends 90 of the axial and lateral segments 62*a*, 62*b*, 64*a*, 64*b*, respectively, of the sheets 56*a*-56*d* (see FIG. 6). The axial and lateral segments 62*a*, 62*b*, 64*a*, 64*b* of the sheets 56*a*-56*d* and the axial and lateral segments of 76*a*, 76*b*, 78*a*, 78*b* of the lining layer 58 are then folded upward (as indicated by the arrows B in FIG. 6) such that the sheets 56*a*-56*d* and the lining layer 58 are shaped into a generally hemispherical shape, thereby forming the shock-absorbing unit 54 for insertion into the outer shell 12. In one embodiment, the sheets 56*a*-56*d* and the lining layer 58 may be formed into any appropriate shape that will conform to and fit a user's head (e.g., concave, dome, oblong shapes, etc.). In this shape, edges 92 of the axial segments 62*a*, 62*b* are positioned adjacent or in close proximity to edges 94 of the lateral segments 64*a*, 64*b* (see FIG. 3). In one embodiment, the ends 88 of the axial segments 76*a*, 76*b* and the lateral segments 78*a*, 78*b* of the lining layer 58 are removably attached to the axial segments 62*a*, 62*b* and the lateral segments 64*a*, 64*b*, respectively, of the sheet 56*d* via a conventional mechanism, such as glue, a double- or one-sided adhesive tape, etc. (see FIG. 3). In another embodiment, due to the sequentially increasing sizes of the sheets 56*a*-56*d*, the ends 90 of the axial and lateral segments 62*a*, 62*b*, 64*a*, 64*b* substantially align with one another when the sheets 56*a*-56*d* and the lining layer 58 are formed into the shock absorbing unit 54.

In one embodiment, the sheets 56*a*-56*d* are not fastened (e.g., glued, stapled, taped, etc.) to one another such that the sheets 56*a*-56*d* are freely slideable relative to each other. In another embodiment, the sheets 56*a*-56*d* can be affixed to one another at one or more selected locations, but without restricting their slideable movement relative to each other.

Once the shock-absorbing unit 54 is formed as discussed above, it is turned upside down (see the orientation of the shock-absorbing unit 54 in FIG. 3) and inserted into the inner cavity 26 of the outer shell 12. More particularly, the axial segments 62*a* and the axial segments 62*b* of the sheets 56*a*-56*d* are positioned adjacent the front and rear portions 14, 16, respectively, of the outer shell 12, while the lateral segments 64*a* and the lateral segments 64*b* of the sheets 56*a*-56*d* are positioned adjacent the lateral side portions 18, 20, respectively, of the outer shell 12 (see FIGS. 7 and 8). In one embodiment, the flap 38 of the outer shell 12 is substantially aligned with the axial segments 62*b* of the sheets 56*a*-56*d* such that the flap 38 and the axial segments 62*b* are pivotable conjointly between an unfolded, in-use position, in which they are generally aligned with the lateral side portions 16, 18 of the outer shell 12 (see FIG. 2), and a folded or collapsed position, in which the flap 38 and the axial segments 62*b* are pivoted into the inner cavity 26 of the outer shell 12 to accommodate collapsing of the side portions 18, 20 of the outer shell 12 toward one another (see FIG. 9).

Figure 7:
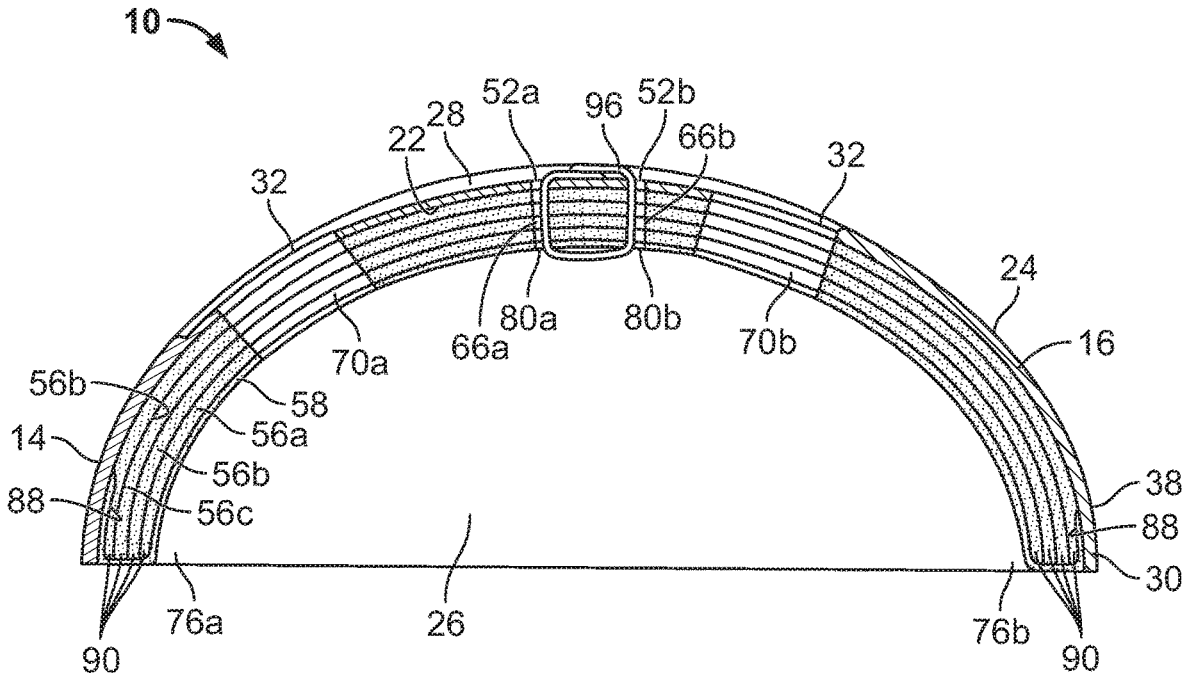
FIG. 7 is a cross-sectional view, taken along section line 7-7 and looking in the direction of the arrows, of the helmet show in FIG. 1.

In one embodiment, a fastening unit 96 (such as a hook and loop strap) is inserted through the slots 52*a*, 52*b* of the outer shell 12, the slots 66*a*, 66*b* of the sheets 56*a*-56*d* and the slots 80*a*, 80*b* of the lining layer 58 so as to secure the shock-absorbing unit 54 to the outer shell 12 (see, e.g., FIGS. 1, 3 and 7). However, because the sheets 56*a*-56*d* and the lining layer 58 are not otherwise fastened to each other or to the outer shell 12, they are slideable relative to each other and the inner shell 12. In one embodiment, the shock-absorbing unit 54 is, at least, partially retained in the outer shell 12 by the natural tendency of the sheets 56*a*-56*d* to expand outwardly (e.g., toward their flat orientations shown in FIGS. 5 and/or 6) and the resulting force applied thereby against the inner surface 22 of the outer shell 12 (and/or the resulting friction between the outer shell 12 and the sheet 56*d* and/or between adjacent pairs of the sheets 56*a*-56*d*). With its 88 ends looping over the respective ends 90 of the axial and lateral segments 62*a*, 62*b*, 64*a*, 64*b* (see FIGS. 7 and 8), the lining layer 58 further assists with retaining the sheets 56*a*-56*d* within the inner cavity 26 of the outer shell 12.

As discussed above, the helmet 10 can be oriented into a collapsed position for storage and/or transport, as shown in FIGS. 10 and 11. With the flap 38 and the axial segments 62*b* of the sheets 56*a*-56*d* pivoted to their folded positions, the helmet 10 is squeezed laterally inwardly such that the lateral side portions 18, 20 are moved toward each other (as indicated by the arrows C in FIG. 9). In one embodiment, the lateral side portions 18, 20 are moved towards one another such that they abut, or are positioned adjacent to, each other. In another embodiment, some spacing may be present between the lateral side portions 18, 20 when the helmet 10 is positioned in its collapsed position (see, e.g., FIG. 10). In its collapsed position, the helmet 10 has an elongated shape suitable for storage, transport, etc.

In order to maintain the helmet 10 in its collapsed position, the straps 44 are pre-adjusted to proper lengths, looped around the helmet 10, and then attached to each other via the clasps 46, in accordance with one embodiment (see FIG. 10). In another embodiment, the helmet 10 is kept in its collapsed position by putting it through a pre-sized sleeve 98 (see FIG. 11). In further embodiments, other retaining mechanisms (e.g., a band, a container, etc.) may be used to retain or maintain the helmet 10 in its collapsed position. In yet another embodiment, the collapsed helmet 10 may be provided at or near locations for bicycle rentals to provide convenient access for users. Further, the helmet 10 may be designed for a single use (i.e., the helmet 10 may be disposable).

The helmet 10 can be oriented from its collapsed position to its open, in-use position by releasing the helmet 10 from its associated retaining mechanism (e.g., the straps 44, the sleeve 98, etc.). In one embodiment, due to the natural tendency of the sheets 56*a*-56*b* to expand toward their generally planar orientations, the helmet 10 expands substantially automatically to its open, in-use position. If the helmet 10 does not expand fully to its open, in-use position, the helmet 10 can be manually expanded by pulling the lateral side portions 18, 20 away from each other.

In use, the helmet 10 is adapted to absorb shock or energy in order to protect a user's head. More particularly, the shock-absorbing materials of the sheets 56*a*-56*d* are adapted to absorb shock or energy applied to the helmet 10. Such shock or energy is further dissipated by sliding movement of the sheets 56*a*-56*d* relative to one another and the outer shell 12.

The helmet 10 may be designed for and/or include additional components to make it useful for various athletic activities, including, but not limited to, cycling, rollerblading, ice skating, skateboarding, skiing, snowboarding, horseback riding and other equestrian activities, rock- or wall-climbing, baseball, football, hockey, lacrosse, jai alai, zip-lining, and waterskiing.

It should be noted that the present invention can have numerous modifications, variations and applications. For instance, the helmet 10 may include fewer or more flexible shock-absorbing sheets, as discussed above.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

We claim:

1. A collapsible helmet adapted to be manually collapsible between an open position, in which said helmet can be fitted to a user's head, and a collapsed position, in which opposing sides of said helmet can be compressed towards each other so as to form said helmet into an elongated shape, comprising an outer shell made from a flexible material and configured to form a protective, hemispherical outer layer, said outer shell including a front portion and a rear portion opposite said front portion, and first and second lateral side portions; a first sheet made from a flexible, shock-absorbing material and adapted to be nested in said outer shell, said first sheet having a first center portion and a plurality of first segments, each of which extends outwardly from said first center portion, said first center portion and said first segments being shaped into a substantially hemispheric shape so as to form a first inner hemispheric layer, said first sheet being movably and slideably retained in said outer shell; and a second sheet made from a flexible, shock-absorbing material and adapted to be nested in said first sheet, said second sheet having a second center portion and a plurality of second segments, each of which extends outwardly from said second center portion, said second center portion and said second segments being formed into a substantially hemispherical shape so as to form a second hemispherical inner layer, said second sheet being movably and slideably retained in said first sheet, wherein said first segments include a first axial segment, which extends from said first center portion in an axial direction and is positioned adjacent said front portion of said outer shell, a second axial segment, which extends from said first center portion in said axial direction away from said first axial segment and is positioned adjacent said rear portion of said outer shell, a first lateral segment, which extends from said first center portion in a lateral direction substantially perpendicular to said axial direction and which is positioned adjacent said first lateral side portion of said outer shell, and a second lateral segment, which extends from said first center portion in said lateral direction away from said first lateral segment and which is positioned adjacent said second lateral side portion of said outer shell, said first and second axial segments and said first and second lateral segments of said first sheet being formed monolithically with said first center portion, wherein said second segments include a third axial segment, which extends from said second center portion in said axial direction and is positioned adjacent said front portion of said outer shell, a fourth axial segment, which extends from said second center portion in said axial direction away from said third axial segment and is positioned adjacent said rear portion of said outer shell, a third lateral segment, which extends from said second center portion in said lateral direction and which is positioned adjacent said first lateral side portion of said outer shell, and a fourth lateral segment, which extends from said second center portion in said lateral direction away from said third lateral segment and which is positioned adjacent said second lateral side portion of said outer shell, said third and fourth axial segments and said third and fourth lateral segments of said second sheet being formed monolithically with said second center portion, and wherein said rear portion includes a flap pivotably attached to said outer shell, said second axial segment of said first sheet and said fourth axial segment of said second sheet being substantially aligned with said flap, said second and fourth axial segments and said flap being movable conjointly between unfolded positions, in which they are generally aligned with said lateral side portions of said outer shell, and folded positions, in which they are folded into said inner cavity of said outer shell.

2. The helmet of claim 1, wherein said helmet is collapsible into its said collapsed position by moving said flap and at least said second and fourth axial segments into their said folded positions and moving said lateral side portions of said outer shell toward each other.

3. The helmet of claim 2, further comprising at least one strap for securing said helmet to a user's head, said at least one strap being adapted to wrap around said outer shell so as to maintain said helmet in its said collapsed position.

4. The helmet of claim 2, further comprising a sleeve sized and shaped to loop around said helmet for maintaining said helmet in its said collapsed position.

5. The helmet of claim 1, wherein said first and second sheets are secured to said outer shell in at least one location.

6. The helmet of claim 5, further comprising a strap, each of said outer shell and said first and second sheets includes slots, said strap inserted through said slots of said outer shell and said first and second sheets so as to secure said first and second sheets to said outer shell.

7. The helmet of claim 6, wherein said strap is configured to secure said first and second sheets to said outer shell without restricting sliding movement of said first sheet relative to said outer shell and without restricting sliding movement of said second sheet relative to said first sheet.

8. The helmet of claim 1, further comprising a third sheet made from a flexible, shock-absorbing material and adapted to be nested in said second sheet, said third sheet having a third center portion and a plurality of third segments, each of which extends outwardly from said third center portion, said third center portion and said third segments being formed into a substantially hemispherical shape so as to form a third hemispherical inner layer, said third sheet being movably and slideably retained in said second sheet; and a fourth sheet made from a flexible, shock-absorbing material and adapted to be nested in said second sheet, said fourth sheet having a fourth center portion and a plurality of fourth segments, each of which extends outwardly from said fourth center portion, said fourth center portion and said fourth segments being formed into a substantially hemispherical shape so as to form a fourth hemispherical inner layer, said fourth sheet being movably and slideably retained in said third sheet.

9. The helmet of claim 1, wherein each of said first segments is formed monolithically with said first center portion; and wherein each of said second segments is formed monolithically with said second center portion.

10. The helmet of claim 1, wherein said first and second sheets are made from a material selected from the group consisting of a flexible foam material, a flexible, vinyl material, a flexible, plastic material and a flexible, fiber mesh material.

11. The helmet of claim 1, further comprising at least one opening extending through said helmet from said outer shell to at least said second sheet for venting said helmet.

12. The helmet of claim 1, further comprising a strap attached between said opposing sides of said helmet for attaching said helmet to a user's head.

13. The helmet of claim 1, wherein said outer shell is slideably movable relative to said first sheet in response to a force impacting said helmet when said helmet is in its said open position on a user's head, whereby said helmet functions to dissipate said force of impact.

* * * * *